United States Patent [19]

Bolha

[11] 4,261,026

[45] Apr. 7, 1981

[54] LIGHTED COASTER FOR DRINKS

[76] Inventor: David J. Bolha, 939 S. Schenley Ave., Youngstown, Ohio 44509

[21] Appl. No.: 44,233

[22] Filed: May 31, 1979

[51] Int. Cl.[3] ..... F21V 33/00; H01H 19/28

[52] U.S. Cl. ..... 362/101; 200/155 A

[58] Field of Search ..... 362/101, 200–201, 362/307–309; 248/346.1; D7/11, 39; 200/60, 155 A

[56] References Cited

U.S. PATENT DOCUMENTS

| | | | |
|---|---|---|---|
| 1,389,132 | 8/1921 | Galavan | 362/101 |
| 2,177,337 | 10/1939 | Stein | 362/101 X |
| 2,611,856 | 9/1952 | Fredin | 362/101 |
| 2,663,866 | 12/1952 | Simpson | 362/101 X |
| 3,218,447 | 11/1965 | Pardue | 362/101 |
| 3,374,344 | 3/1968 | Rudolph et al. | 362/101 |
| 3,745,947 | 5/1956 | Sansous | 362/101 X |
| 3,878,386 | 4/1975 | Douglas | 362/101 |
| 4,034,213 | 7/1977 | Norris | 362/200 |

FOREIGN PATENT DOCUMENTS

| | | | |
|---|---|---|---|
| 1498436 | 9/1967 | France | 362/101 |

*Primary Examiner*—L. T. Hix
*Assistant Examiner*—Thomas H. Tarcza
*Attorney, Agent, or Firm*—Webster B. Harpman

[57] ABSTRACT

A lighted coaster for drinks provides a base with a light source, a reflector adjacent the light source and a translucent supporting surface upon which a glass can be placed.

1 Claim, 4 Drawing Figures

LIGHTED COASTER FOR DRINKS

BACKGROUND OF THE INVENTION (1) Field of the Invention

This invention relates to illuminated coasters of the type having power supply and light sources.

(2) Description of the Prior Art

Prior illuminated coasters of this type have used a variety of light sources and lenses. See for example U.S. Pat. Nos. 4,034,213; 3,218,447 and 2,611,856.

In U.S. Pat. No. 4,034,213 an illuminated insert is disclosed having a power and light source enclosed in a submersible container to be placed inside the bottom of the drinking glass.

In U.S. Pat. No. 3,218,447 a drinking glass is shown having a battery and light source positioned within the stem of the glass for the illumination of the liquid therein.

Applicant's device is a coaster on which a drinking glass is placed, having a large supporting illuminated surface in addition to a spotlight for the illumination of the liquid within the glass.

In U.S. Pat. No. 2,611,856, a liquid holding pan having an illuminated support is disclosed wherein a light bulb having a lens is positioned in a base that will hold water from a melting ice statue or the like positioned above the light for illumination.

Applicant's device is a lighted coaster having a large supporting illuminated surface, a power source and does not have any reservoir or provisions for liquid storage.

SUMMARY OF THE INVENTION

A lighted coaster upon which drinks in the glasses are placed having a self-contained power source with a light bulb and lens combination therein with a large reflector and translucent supporting surface for the drink which allows both even illumination of the supporting surface and a focased beam of light within the drink placed thereon.

DESCRIPTION OF THE PREFERRED EMBODIMENT

Figure 1:
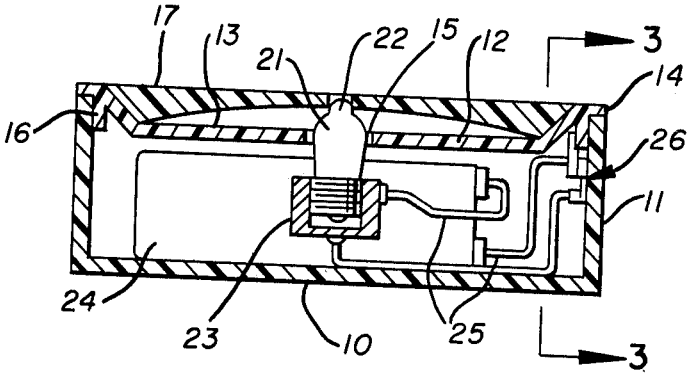
FIG. 1 is a cross sectional view of the lighted coaster as seen on line 1—1 of FIG. 3.

In the form of the invention chosen for illustration, an illuminated coaster for drinks or the like comprises, as will best be seen in FIG. 1 of the drawings, a circular base member 10 having an annular upstanding side wall 11 extending therefrom. An annular dish shaped body member 12 having an upper reflective surface has a center portion 13 and a perimeter 14 with an aperture 15 centrally located in the center portion 13 which is on a lower horizontal plane than the perimeter 14.

Figure 2:
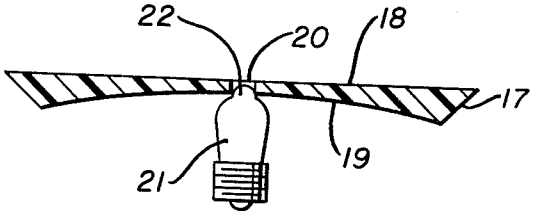
FIG. 2 is a detail in cross section of a part of the device of FIG. 1.
Figure 3:
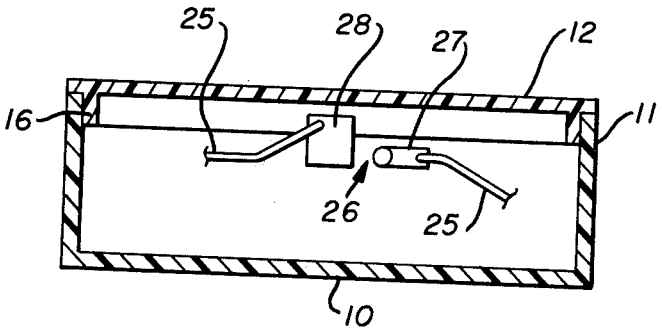
FIG. 3 is a cross section on line 3—3 of FIG. 1.
Figure 4:
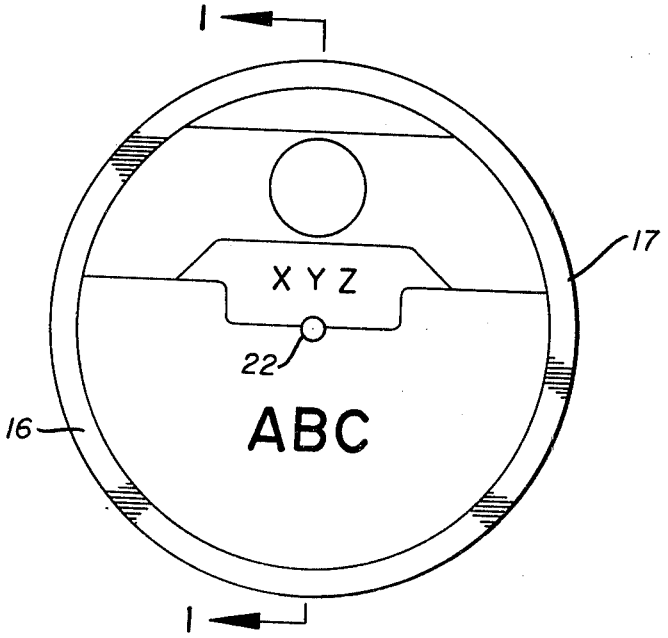
FIG. 4 is a top plan view of the lighted coaster for drinks.

A downwardly extending annular flange 16 depends from the perimeter 14 and the downwardly extending annular flange 16 is slidably engaged on the inner side of said annular side wall 11. A circular translucent disc 17 having an upper surface 18 and a concave lower surface 19 has an aperture 20 centrally positioned therein. The circular translucent disc 17 is located within the area defined by said circular dish shaped body member 12. A light bulb 21 with a lens 22 formed in the uppermost portion thereof is mounted in a socket 23 mounted in the base member 10, the bulb 21 being so positioned as to pass through said aperture 15 in the dish-shaped body member 12 with the upper lens portion 22 extending into the area defined by the aperture 20 in said translucent disc 17 as will best be seen in FIG. 2 of the drawings.

A battery 24 located in the base member 10 supplies power for the bulb 21 through a pair of connecting wires 25 and a switch 26. The switch 26 comprises a first contact terminal 27 secured to the side wall 11 and a second contact terminal 28 which is secured to the inner side of the downwardly extending annular flange of the body member 12 so that when the body member 12 is rotated, the second contact terminal 28 will engage the first contact terminal 27 and complete the electrical circuit between the battery 24 and the light bulb 21.

It will thus be seen that a lighted coaster for drinks has been described and it will be apparent from the description that the upper surface of the translucent disc 17 can be and preferably is formed on two or more levels for limited engagement with an object on said disc to present an attractive appearance and can incorporate an advertisement, such as a trademark of a beverage. The novel arrangement of the disc 17, the dish shaped body member 12 and its sliding friction fit in and on the side wall 11, provides a compact, attractive, functional coaster that lights up the disc 17 and its decoration or advertisement as well as the drink in a glass positioned thereon.

Although but one emodiment of the present invention has been illustrated and described, it will be apparent to those skilled in the art that various changes and modifications may be made therein without departing from the spirit of the invention and having thus described my invention what I claim is:

1. A lighted coaster comprising a base having an upstanding annular side wall, a light bulb supporting socket and a power source on said base, conductors and a switch connecting said socket and power source, an annular body member having a depending annular flange rotatably supported on said side wall, a translucent disc on said body member, said switch comprising first and second parts, said first part being positioned on said annular side wall and said second part being positioned on said depending annular flange of said annular body member and arranged for registry with said first part when said annular body member is rotated relative to said annular flange so as to move said first and second parts toward and away from one another, a light bulb in said socket positioned partially in registering openings in the centers of said body member and said transulcent disc, whereby said translucent disc and an object on said coaster are illuminated when said light bulb is lit.

* * * * *